US006938384B1

(12) United States Patent
Hodge

(10) Patent No.: US 6,938,384 B1
(45) Date of Patent: Sep. 6, 2005

(54) BEACH TOWEL STAKE

(76) Inventor: Michael E. Hodge, P.O. Box 254, Tazewell, VA (US) 24651

( * ) Notice: Subject to any disclaimer, the term of this patent is extended or adjusted under 35 U.S.C. 154(b) by 0 days.

(21) Appl. No.: 10/610,896

(22) Filed: Jul. 1, 2003

(51) Int. Cl.[7] ..... E04H 15/62; E02D 5/80
(52) U.S. Cl. ..... 52/155; 135/118; 5/417; 411/485; 411/486; D8/391; D21/840
(58) Field of Search ..... 135/118; 52/155; 248/508, 530, 156; D21/840; D8/391; 411/485, 411/486; 5/417

(56) References Cited

U.S. PATENT DOCUMENTS 3,456,660 A * 7/1969 Borchardt ..... 135/118
3,788,336 A * 1/1974 Steffes ..... 135/118
D282,104 S * 1/1986 Taylor ..... D25/77
D333,526 S * 2/1993 Taylor ..... D25/131
D377,076 S * 12/1996 Adams ..... D21/255
D378,980 S * 4/1997 Thayer et al. ..... D8/1
D380,569 S * 7/1997 Garber ..... D26/67
D415,018 S * 10/1999 Uhler ..... D8/840
6,631,527 B2 * 10/2003 Hyduk ..... 5/417
2003/0019034 A1 * 1/2003 Hyduk ..... 5/417

* cited by examiner

*Primary Examiner*—Robert Canfield

(57) ABSTRACT

Beach towel stakes anchor a beach towel in sand or soft earth. The beach towel stakes have a shaft with a pointed end to facilitate their insertion into the ground. A cap and catch hook are attached to the shaft's opposing end. A lanyard is inserted through a lanyard hole in the shaft's opposing end. The cap has a viewing notch in its edge located above the catch hook. The catch hook is L-shaped and is adapted to receive a beach towel. The user can easily insert shaft 12 into sand by applying pressure to the top of the cap 14 and remove the shaft 12 by pulling on lanyard 24.

1 Claim, 3 Drawing Sheets

BEACH TOWEL STAKE

BACKGROUND OF THE INVENTION

1. Field of the Invention

The present invention relates to a beach towel stake for use in connection with anchoring devices. The beach towel stake has particular utility in connection with anchoring a beach towel in sand or soft earth.

2. Description of the Prior Art

Beach towel stakes are desirable for anchoring a beach towel in sand or soft earth. It is a common practice for beachgoers to lay a beach towel or blanket on the ground so that they do not have to sit directly on hot sand. However, the position of the beach towel or blanket can be disturbed by gusts of wind, resulting in overturned corners or significant displacement of the entire towel or blanket. Objects such as coolers, rocks, shoes, piles of sand, or shells are sometimes used to combat this problem, but present a risk of tripping and prevent the items from being used for their more common purposes. Beach towel stakes overcome these difficulties by providing a secure means of fastening a beach towel or blanket to the ground so that it cannot be adversely affected by gusts of wind. Furthermore, the beach towel stakes can be placed flush with the ground so as to not pose a tripping risk.

The use of picnic cloth holders is known in the prior art. For example, U.S. Pat. No. 2,647,718 to Disera discloses a picnic cloth holder. However, the Disera '718 patent does not have a catch hook, and has further drawbacks of lacking a viewing notch.

U.S. Pat. No. 5,176,354 to Feigenbaum, Jr. discloses a blanket anchor that anchors a blanket in sand or soft earth. However, the Feigenbaum, Jr. '354 patent does not have a lanyard, and additionally does not have a viewing notch.

Similarly, U.S. Pat. No. 5,579,798 to Pruitt discloses an apparatus and method for anchoring a covering that anchors various types of coverings to the ground. However, the Pruitt '798 patent does not have a lanyard, and does not have a viewing notch.

In addition, U.S. Pat. No. Des. 398,514 to Anderson discloses a stake for anchoring a beach blanket that anchors a beach blanket to the ground. However, the Anderson '514 patent does not have a catch hook, and also does not have a viewing notch.

Furthermore, U.S. Pat. No. 5,101,525 to Ippolito discloses a combination stake anchored down beach and lawn blanket that anchors the blanket to either a beach surface or a lawn surface. However, the Ippolito '525 patent does not have a catch hook, and further lacks a viewing notch.

Lastly, U.S. Pat. No. 6,226,813 to Wilburn et al. discloses an anchoring system for a beach blanket that anchors a beach blanket to the ground or sand. However, the Wilburn et al. '813 patent does not have a catch hook, and has the additional deficiency of lacking a viewing notch.

While the above-described devices fulfill their respective, particular objectives and requirements, the aforementioned patents do not describe a beach towel stake that allows anchoring a beach towel in sand or soft earth. The above patents make no provision for a viewing notch. The Disera '718 patent, the Anderson '514 patent, the Ippolito '525 patent, and the Wilburn et al. '813 patent do not have a catch hook. The Feigenbaum, Jr. '354 patent and the Pruitt '798 patent lack a lanyard.

Therefore, a need exists for a new and improved beach towel stake that can be used for anchoring a beach towel in sand or soft earth. In this regard, the present invention substantially fulfills this need. In this respect, the beach towel stake according to the present invention substantially departs from the conventional concepts and designs of the prior art, and in doing so provides an apparatus primarily developed for the purpose of anchoring a beach towel in sand or soft earth.

SUMMARY OF THE INVENTION

In view of the foregoing disadvantages inherent in the known types of picnic cloth holders now present in the prior art, the present invention provides an improved beach towel stake, and overcomes the above-mentioned disadvantages and drawbacks of the prior art. As such, the general purpose of the present invention, which will be described subsequently in greater detail, is to provide a new and improved beach towel stake which has all the advantages of the prior art mentioned heretofore and many novel features that result in a beach towel stake which is not anticipated, rendered obvious, suggested, or even implied by the prior art, either alone or in any combination thereof.

To attain this, the present invention essentially comprises a shaft with a cap attached to one end. The outer edge of the cap has a notch in it to comprise a viewing notch.

There has thus been outlined, rather broadly, the more important features of the invention in order that the detailed description thereof that follows may be better understood and in order that the present contribution to the art may be better appreciated.

The invention may also include a catch hook being attached to the end of the shaft. A lanyard may be inserted through a lanyard hole in the end of the shaft. The lanyard may be made of string, wire cable, or chain. The opposing end of the shaft may taper to a point. The cap may be round. The top of the cap may be flat. The cap and the shaft may be made of plastic, steel, aluminum, titanium, wood, or carbon fiber composite. The cap may have a diameter of about 1¾ inches. The shaft may have a length of about six inches. The catch hook may be adapted to receive a beach towel. The catch hook may be L-shaped. The viewing notch may be positioned directly above the catch hook. The invention may also be a kit for securing a beach towel comprising a plurality of beach towel stakes removably enclosed by a container adapted to receive them. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach towel stake that has all of the advantages of the prior art picnic cloth holders and none of the disadvantages.

It is another object of the present invention to provide a new and improved beach towel stake that may be easily and efficiently manufactured and marketed.

An even further object of the present invention is to provide a new and improved beach towel stake that has a low cost of manufacture with regard to both materials and labor, and which accordingly is then susceptible of low prices of sale to the consuming public, thereby making such beach towel stake economically available to the buying public.

Still another object of the present invention is to provide a new beach towel stake that provides in the apparatuses and methods of the prior art some of the advantages thereof, while simultaneously overcoming some of the disadvantages normally associated therewith.

Even still another object of the present invention is to provide a beach towel stake for anchoring a beach towel in sand or soft earth. This allows the user to press the beach towel stake into the ground or sand using their hand or foot easily.

Still yet another object of the present invention is to provide a beach towel stake for anchoring a beach towel in sand or soft earth. This makes it possible to remove the beach towel stake from the sand and or ground easily.

An additional object of the present invention is to provide a beach towel stake for anchoring a beach towel in sand or soft earth. This prevents a beach towel from been adversely affected by a gust of wind.

A further object of the present invention is to provide a beach towel stake for anchoring a beach towel in sand or soft earth. This allows the beach towel stake to be flush with the ground while in use.

Lastly, it is an object of the present invention to provide a new and improved beach towel stake for anchoring a beach towel in sand or soft earth.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
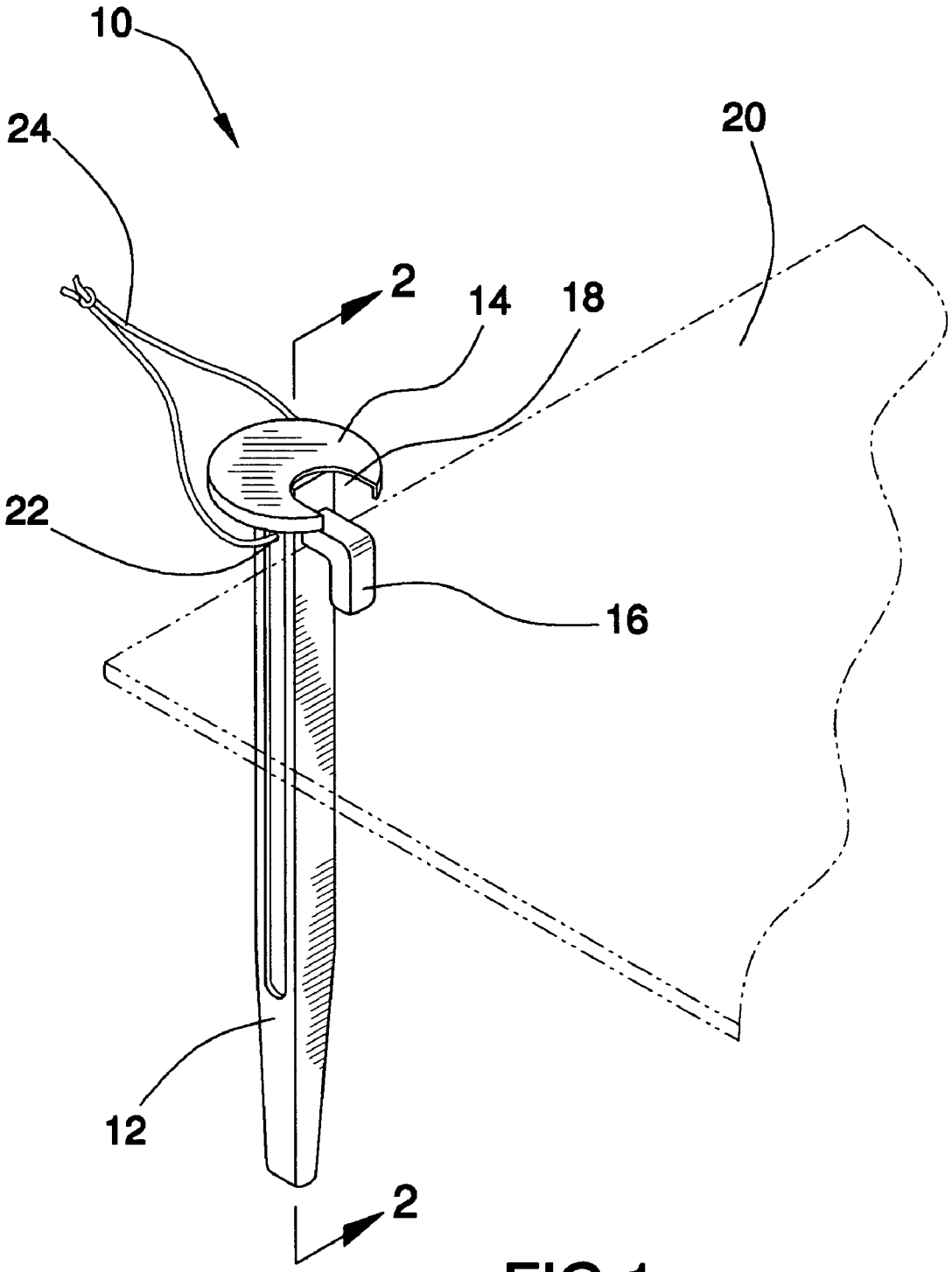
FIG. 1 is a top perspective view of the current embodiment of the beach towel stake constructed in accordance with the principles of the present invention.
Figure 2:
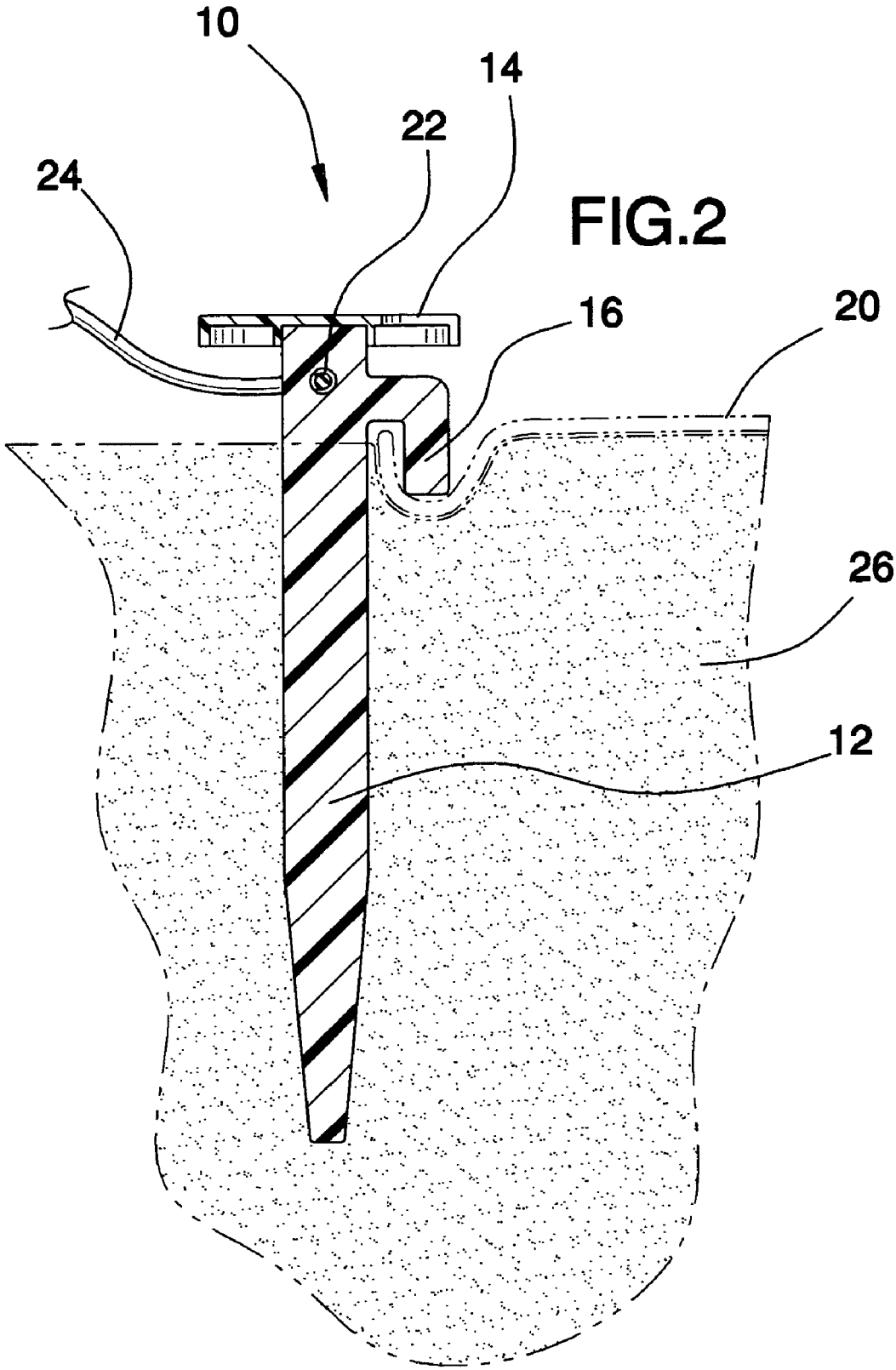
FIG. 2 is a side sectional view of the beach towel stake of the present invention.
Figure 3:
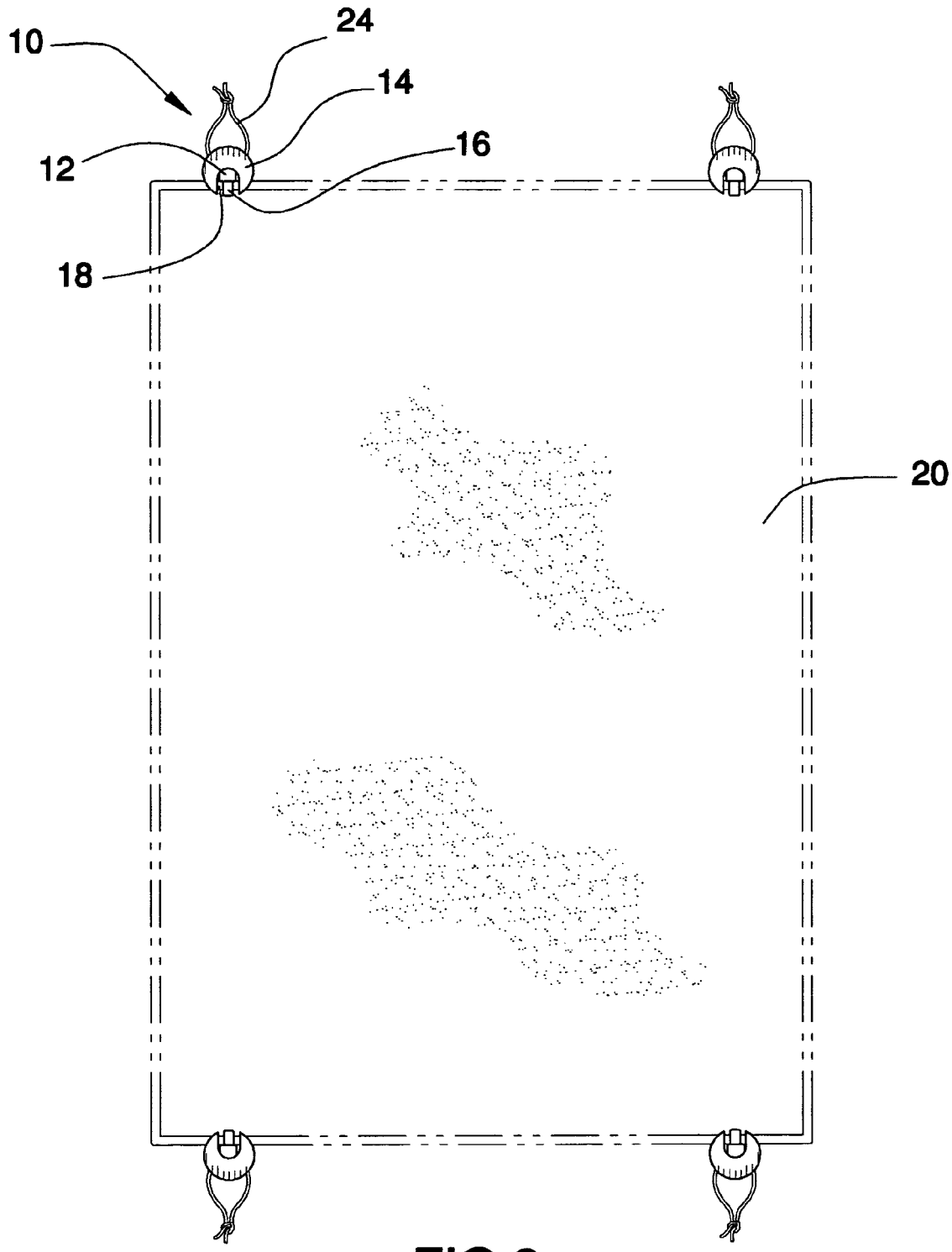
FIG. 3 is a top side view of the beach towel stake of the present invention.

Referring now to the drawings, and particularly to FIGS. 1–3, a current embodiment of the beach towel stake of the present invention is shown and generally designated by the reference numeral 10.

In FIG. 1, a new and improved beach towel stake 10 of the present invention for anchoring a beach towel in sand or soft earth is illustrated and will be described. More particularly, the beach towel stake 10 has a shaft 12, made of plastic in the current embodiment. One end of shaft 12 tapers to a point, while the other end is attached to the bottom of cap 14. In the current embodiment, cap 14 is made of plastic, is generally round in shape, and has a flat top. A catch hook 16 is also attached to the other end of shaft 12. A viewing notch 18 is present in the outer edge of cap 14 directly above catch hook 16. In the current embodiment, catch hook 16 is L-shaped and is adapted to receive the edge of a beach towel 20. Viewing notch 18 allows the user (not shown) to view the position of beach towel 20 with respect to the catch hook 16. A lanyard hole 22 pierces the opposing end of the shaft 12 and receives a lanyard 24. In the current embodiment, lanyard 24 is made of string. Note that the broken lines illustrating the beach towel 20 are for illustrative purposes only and are not part of the current invention.

Moving on to FIG. 2, a new and improved beach towel stake 10 of the present invention for anchoring a beach towel in sand or soft earth is illustrated and will be described. More particularly, the beach towel stake 10 has a shaft 12 attached to the bottom of cap 14. The beach towel stake 10 is shown in use with shaft 12 having its pointed end driven into sand 26. The catch hook 16 is shown securing the edge of beach towel 20 to the sand 26, thereby preventing the edge of beach towel 20 from being displaced by a gust of wind. The lanyard 24 is inserted through lanyard hole 22. The lanyard 24 facilitates the removal of the beach towel stake 10 from the sand 26 when the user (not shown) desires to change the location of the beach towel 20. Note that the broken lines illustrating the beach towel 20 and the sand 26 are for illustrative purposes only and are not part of the current invention.

Concluding with FIG. 3, a new and improved beach towel stake 10 of the present invention for anchoring a beach towel in sand or soft earth is illustrated and will be described. More particularly, the beach towel stake 10 has a catch hook 16 adapted to anchor a beach towel 20 when shaft 12 is driven into the ground (not shown). A viewing notch 18 in the cap 14 allows the position of the beach towel 20 with respect to the catch hook 16 to be easily ascertained. A lanyard 24 facilitates the removal of the beach towel stake 10 from the ground. A portion of a kit for securing a beach towel 20 is shown in the form of the four beach towel stakes 10 illustrated. Note that the broken lines illustrating the beach towel 20 are for illustrative purposes only and are not part of the current invention.

In use, it can now be understood that the user first positions the beach towel 20 or blanket in the desired location. Next, the catch hook 16 of one beach towel stake 10 is positioned atop one corner of the beach towel 20 or blanket. The user then drives the beach towel stake 10 into the sand 26 using their hand or foot. A glance through the viewing notch 18 allows the user to ensure that the catch hook 16 is properly engaging the beach towel 20. The user then repeats this procedure with additional beach towel stakes 10 until the beach towel 20 is firmly anchored to the sand 26. When the user wishes to change the location of the beach towel 20, the user can easily remove the beach towel stakes 10 by pulling on the lanyard 24 connected to each one to remove the shaft 12 from the sand 26.

While a current embodiment of the beach towel stake has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, steel, aluminum, titanium, wood, or carbon fiber composite may be used instead of the plastic cap and shaft described. Also, the string lanyard may also be made of wire cable or chain. And although anchoring a beach towel in sand or soft earth has been described, it should be appreciated that the beach towel stake herein described is also suitable for anchoring a wide variety of objects to the ground, such as blankets, tarpaulins, and tents. Furthermore, a wide variety of cap shapes may be used instead of the round shape described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beach towel stake comprising;

a cap having a top, a bottom, and an outer edge;

a viewing notch, wherein said outer edge of said cap defines a notch therein to comprise said viewing notch;

a shaft having opposing ends with one end attached to said bottom of said cap;

a catch hook attached to said one end of said shaft; and said viewing notch positioned directly above said catch hook.

* * * * *